US006324854B1

(12) United States Patent
Jayanth

(10) Patent No.: US 6,324,854 B1
(45) Date of Patent: Dec. 4, 2001

(54) AIR-CONDITIONING SERVICING SYSTEM AND METHOD

(75) Inventor: Nagaraj Jayanth, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/721,594

(22) Filed: Nov. 22, 2000

(51) Int. Cl.[7] ..... F25B 49/02
(52) U.S. Cl. ..... 62/127; 236/94; 165/11.1
(58) Field of Search ..... 62/125, 126, 127, 62/129, 130, 298; 165/11.1; 236/94

(56) References Cited

U.S. PATENT DOCUMENTS

| | | | | |
|---|---|---|---|---|
| 4,755,957 | | 7/1988 | White et al. | 364/551 |
| 4,798,055 | * | 1/1989 | Murray et al. | 62/129 X |
| 5,209,400 | * | 5/1993 | Winslow et al. | 62/127 X |
| 5,440,890 | | 8/1995 | Bahel et al. | 62/81 |
| 5,440,895 | | 8/1995 | Bahel et al. | 62/223 |
| 5,511,387 | | 4/1996 | Tinsler | 62/292 |
| 5,528,908 | | 6/1996 | Bahel et al. | 62/81 |
| 5,548,966 | | 8/1996 | Tinsler | 62/77 |
| 5,630,325 | | 5/1997 | Bahel et al. | 62/222 |
| 5,875,638 | | 3/1999 | Tinsler | 62/149 |
| 6,179,214 | * | 1/2001 | Key et al. | 62/127 X |

* cited by examiner

*Primary Examiner*—Harry B. Tanner
(74) *Attorney, Agent, or Firm*—Harness, Dickey & Pierce, P.L.C.

(57) ABSTRACT

An air conditioning servicing system utilizes a number of sensors which monitor various operating parameters of a malfunctioning air-conditioning system. These operating parameters are provided to a hand held computer along with an identifier of the malfunctioning air-conditioning system. The hand held computer contains the normal operating parameters for a plurality of air-conditioning systems. The hand held computer compares the measured operating parameters with the normal operating parameters for the specific air-conditioning system to provide diagnostic results for the malfunctioning system and possible service procedures. If the hand held computer does not recognize the malfunctioning air-conditioning system identifier, a wireless connection is made through the Internet to a master computer which has a larger data base.

20 Claims, 2 Drawing Sheets

AIR-CONDITIONING SERVICING SYSTEM AND METHOD

FIELD OF THE INVENTION

The present invention relates generally to an apparatus and a method for servicing an air-conditioning system. More particularly, the present invention relates to an apparatus and a method for servicing an air-conditioning system which utilizes a data acquisition system for communicating with the air-conditioning system and a hand held compute which analyzes the information received from the data acquisition system.

BACKGROUND AND SUMMARY OF THE INVENTION

Several air-conditioning service units are available to assist a trained technician in servicing an air-conditioning system. Some prior art units are adapted to be connected to the high- and low-pressure sides of the air-conditioning system and these units include gauges for measuring the high and low side pressures of the system under the appropriate operating conditions. These measured values are then manually compared with known standards for the particular air-conditioning system being tested. From this manual comparison and other observable characteristics of the system, the technician decides whether or not the system is operating properly. If a system malfunction is indicated, the technician determines the possible causes of the malfunction and decides how the system should be repaired.

Expensive and high-end large commercial air-conditioning systems are typically provided with their own sophisticated electronics and a host of internal sensors. The sophisticated electronics and the host of sensors for these large commercial systems simplify the diagnosis for these systems. However, the costs associated with these electronics and the sensors is too much for cost sensitive systems like residential air-conditioning systems and small commercial installations. In these smaller systems, the servicing efficiency is still dependent upon the skill of the technician. The tools that the technician typically uses to help in the diagnosis are pressure gauges, service units which suggest possible fixes, common electronic instruments like multimeters and component data books which supplement the various service units that are available. Even though these tools have improved over the years in terms of accuracy, ease of use and reliability, the technician still has to rely on his own personal skill and knowledge in interpreting the results of these instruments. The problems associated with depending upon the skill and knowledge of the service technician is expected to compound in the future due in part to the introduction of many new refrigerants. Thus, the large experience that the technicians have gained on current day refrigerants will not be adequate for the air-conditioning systems of the future. This leads to a high cost for training and a higher incident of misdiagnosing which needs to be addressed.

During the process of this diagnosis by the technician, he typically relies on his knowledge and his past experience. Thus, accurate diagnosis and repair require that the technician possess substantial experience. The problem of accurate diagnosis is complicated by the large number of different air-conditioning systems in the marketplace. While each air-conditioning system includes a basic air-conditioning cycle, the various systems can include components and options that complicate the diagnosis for the system as a whole. Accordingly, with these prior art service units, misdiagnosis can occur, resulting in improperly repaired systems and in excessive time to complete repairs.

Although service manuals are available to assist the technician in diagnosing and repairing the air-conditioning systems, their use is time-consuming and inefficient. In addition, the large number of manuals require valuable space and each manual must be kept up to date.

In order to improve over the above described diagnosis procedures, service units have been designed which employ electronic processing means for initially diagnosing the air-conditioning system and, thereafter, if tests or repairs are needed, for guiding the mechanic to correction of its defective operation. When using these prior art service units, the technician identifies what type of system is being diagnosed. The service units are then capable of receiving signals which are indicative of the high and low side pressures of the air-conditioning system. Based upon the observed pressures in relation to the programed standards for the type of air-conditioning system being tested, the service unit indicates whether or not the system is functioning properly. If the air-conditioning system is not functioning properly, a list of possible defective components and/or other possible causes of the system malfunction are identified. This list could range from a complete self-diagnosis where the problem is clearly identified to interactive dialog that narrows down the possible causes of the problem. The systems that monitor only the high and low pressure side pressures of the air-conditioning system are thus inherently limited in their diagnostic ability. What is needed is an air-conditioning service system which monitors not only the system's pressures, but the system should monitor other conditions such as various temperatures within the system as well as operating parameters of the motor driving the system in order to enable a more accurate diagnosis.

The present invention provides the art with a diagnostic system which is applicable to the present day air-conditioning systems as well as being adaptable to the air-conditioning systems of the future. The present invention provides a data acquisition system which includes a judicious integration of sensors. The sensors monitor the system's pressures, various temperatures within the system as well as operating parameters for the motor driving the system. By incorporating these additional sensors and specifically the motor operating sensors, the data acquisition system can provide better diagnostic results for the air-conditioning system. The data acquisition system coupled with a hand held computer using sophisticated software provides a reasonable cost diagnostic tool for a service technician. In the very cost sensitive systems like residential air-conditioning systems, this diagnostic tool eliminates the need for having each system equipped with independent sensors and electronics, yet they will still have the capability to assist the technician to efficiently service the air-conditioning system when there is a problem. The diagnostic tool also includes a wireless Internet link with a master computer which contains the service information on all of the various systems in use. In this way, the hand held computer can be constantly updated with new information as well as not being required to maintain files on every system. If the technician encounters a system not on file in his hand held computer, a wireless Internet link to the master computer can identify the missing information.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
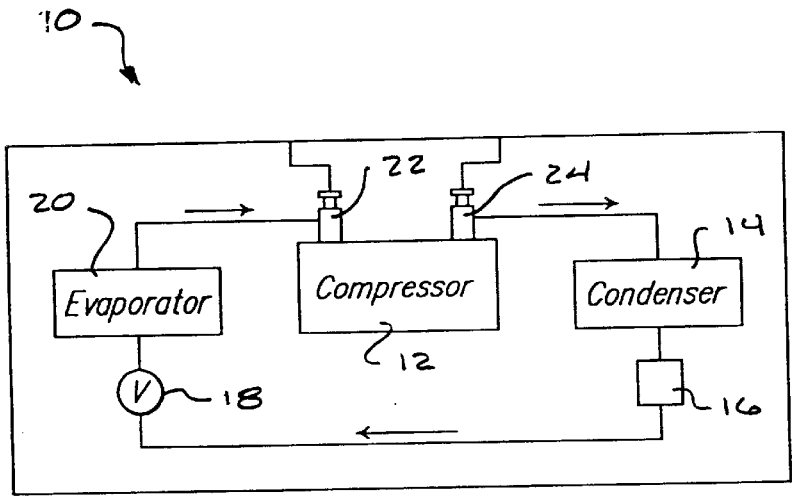
FIG. 1 schematically illustrates a typical air-conditioning system in accordance with the present invention.

Referring now to the drawings in which like reference numerals designate like or corresponding parts throughout the several views, there is shown in FIG. 1 an air-conditioning system for use with the service system in accordance with the present invention and which is designated generally by the reference numeral 10. Air-conditioning system 10 comprises a compressor 12 which compresses refrigerant gas and delivers it to a condensor 14 where the compressed gas is converted to a liquid. Condensor 14 discharges through a sight glass 16 which provides visual observation of the fill level of refrigerant in the system during operation. Sight glass 16 also normally includes a reservoir for storing liquid refrigerant under conditions of large load fluctuations on the system, and includes a high-pressure filter and desiccant to trap and hold any moisture or solid particles which may be present in the system. From sight glass 16, the refrigerant is delivered through an expansion valve 18 to an evaporator 20 where the refrigerant is evaporated into gaseous form as the system provides cooling in a well known manner. From evaporator 20, the refrigerant returns to compressor 12 to again start the above described refrigeration cycle.

For purposes of initial charging system 10 and for periodic servicing of system 10, compressor 12 has a pair of refrigerant ports 22 and 24. Port 22 is located at or near the low pressure suction port for compressor 12 and port 24 is located at or near the high pressure discharge port for compressor 12. Ports 22 and 24 provide connections for pressure gauge readings and for the addition of refrigerant and/or lubricating oil at either the suction side or the discharge side of compressor 12.

Figure 2:
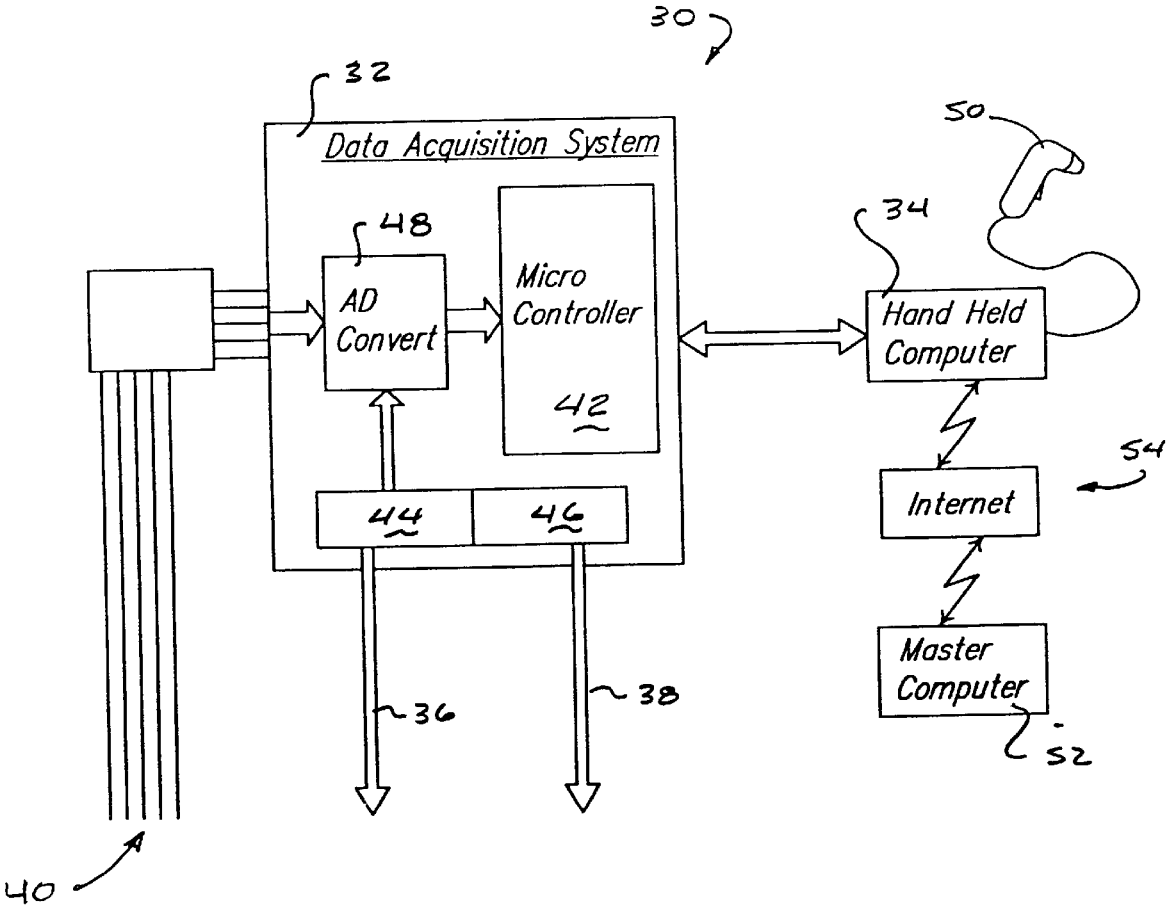
FIG. 2 schematically illustrates an air-conditioning service system in accordance with the present invention.
Figure 3:
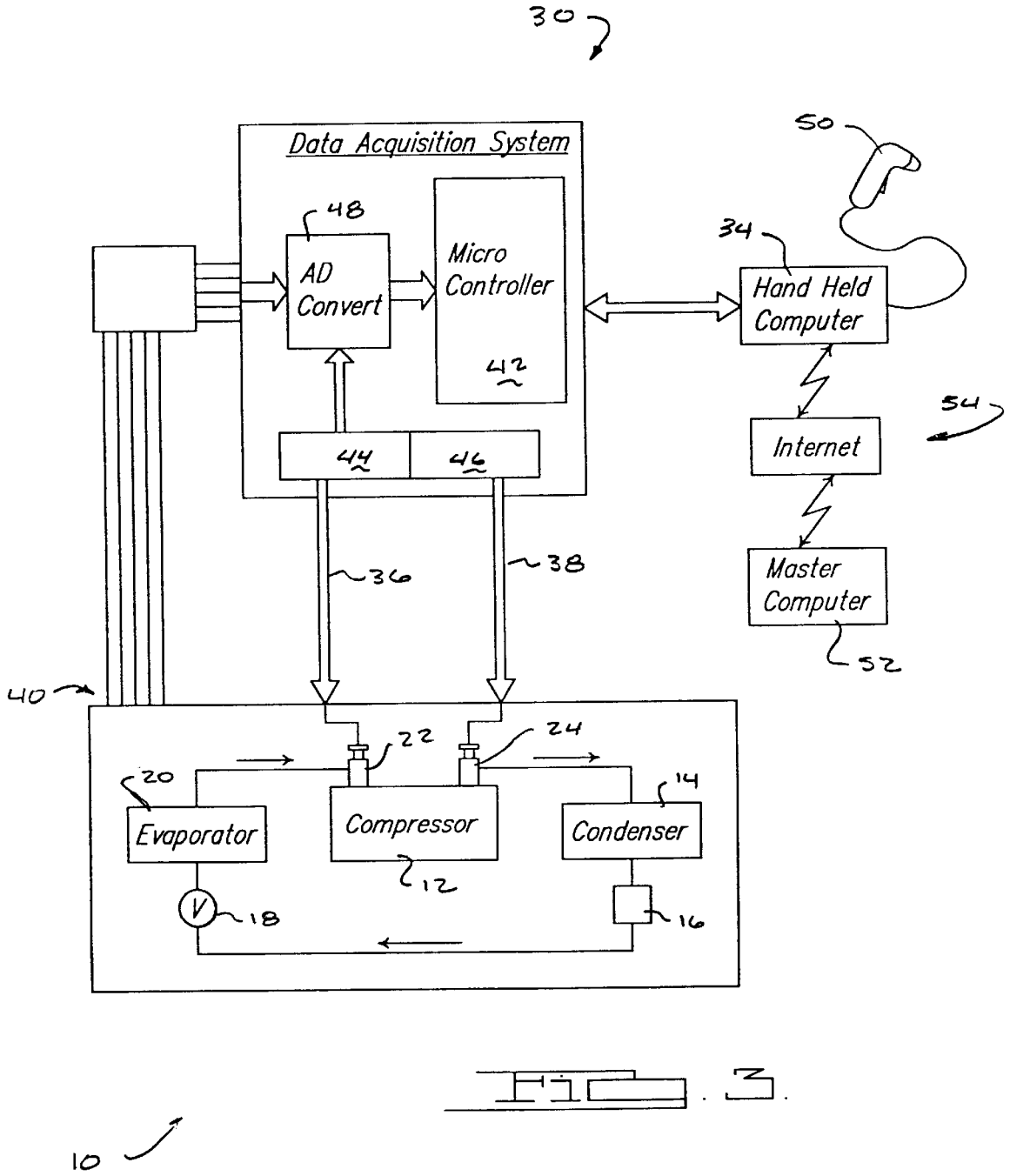
FIG. 3 schematically illustrates the air-conditioning service system shown in FIG. 2 coupled with the air-conditioning system shown in FIG. 1.

Referring now to FIGS. 2 and 3, an air-conditioning service system or apparatus 30 is illustrated. Apparatus 30 comprises a data acquisition system 32, a hand held computer 34, a pair of pressure hoses 36 and 38, and a plurality of sensors 40. Data acquisition system 32 includes a micro-controller 42, a pair of pressure sensors 44 and 46 and an Analog to Digital converter 48. Pressure hose 36 is adapted to be attached to port 22 to monitor the pressure at or near the suction port of compressor 12. Pressure hose 38 is adapted to be attached to port 24 to monitor the pressure at or near the discharge port of compressor 12. Each hose 36 and 38 is in communication with sensors 44 and 46, respectively, and each sensor 44 and 46 provides an analog signal to A/D converter 48 which is indicative of the pressure being monitored. A/D converter 48 receives the analog signal from sensors 44 and 46, converts this analog signal to a digital signal which is indicative of the pressure being monitored and provides this digital system to micro-controller 42.

Sensors 40 are adapted to monitor various operating characteristics of compressor 12. Several sensors 40 monitor specific temperatures in the system, one sensor monitors compressor supply voltage, one sensor monitors compressor supply amperage and one sensor monitors the rotational speed (RPM) for compressor 12. Typical temperatures that can be monitored include evaporator refrigerant temperature, condenser refrigerant temperature, ambient temperature and conditioned space temperature. The analysis of parameters like compressor voltage, compressor current, compressor RPM and discharge temperature can provide valuable information regarding the cause of the problem. Each sensor 40 is connected to A/D converter 48 and sends an analog signal indicative of its sensed parameter to A/D converter 48. A/D converter 48 receives the analog signals from sensors 40 and converts them to a digital signal indicative of the sensed parameter and provides this digital signal to micro-controller 42.

Micro-controller 42 is in communication with computer 34 and provides to computer 34 the information provided by micro-controller 42. Once computer 34 is provided with the air-conditioning system configuration and the sensed parameters from sensors 40, 44 and 46, a diagnostic program can be performed. The air-conditioning system configuration can be provided to computer 34 manually by the technician or it can be provided to computer 34 by a bar code reader 50 if the air-conditioning system is provided with a bar code label which sufficiently identifies the air-conditioning system.

In order for the diagnostic program to run, computer 34 must know what the normal parameters for the monitored air conditioning system should be. This information can be kept in the memory of computer 34, it can be kept in the larger memory of a master computer 52 or it can be kept in both places. Master computer 52 can be continuously updated with new models and revised information as it becomes available. When accessing the normal parameters in its own memory, computer 34 can immediately use the saved normal parameters or computer 34 can request the technician to connect to master computer 52 to confirm and/or update the normal parameters. The connection to the master computer 52 is preferably accomplished through a wireless Internet connection 54 in order to simplify the procedure for the technician. Also, if the particular air conditioning system being monitored is not in the memory of computer 34, computer 34 can prompt the technician to connect to master computer 52 using wireless Internet connection 54 to access the larger data base which is available in the memory of master computer 52. In this way, computer 34 can include only the most popular systems in its memory but still have access to the entire population or air-conditioning systems through connection 54. While the present invention is being illustrated utilizing wireless Internet connection 54, it is within the scope of the present invention to communicate between computers 34 and 52 using a direct wireless or a wire connection if desired.

The technician using apparatus 30 would first hook up pressure hose 36 to port 22 and pressure hose 38 to port 24. The technician would then hook up the various temperature sensors 40, the compressor supply voltage and current sensors 40 and the compressor RPM sensor 40. The technician would then initialize computer 34 and launch the diagnostics application software. The software on start-up prompts the technician to set up the test session. The technician then picks various options such as refrigerant type of the system and the system configuration, like compressors and system model number, expansion device type or other information for the configuration system. Optionally this information can be input into computer 34 using a barcode label and barcode reader 50 if this option is available. The software then checks to see if the operating information for the system or the compressor model exists within its memory. If this information is not within its memory, computer 34 will establish a wireless connection to master computer 52 through wireless Internet connection 54 and access this information from master computer 52. Also, optionally, computer 34 can prompt the technician to update the existing information in its memory with the information contained in the memory of master computer 52 or computer 34 can prompt the technician to add the missing information to its memory from the memory of master computer 52.

Once the test session is set up, the software commands micro-controller 42 to acquire the sensed values from sensors 40, 44 and 46. Micro-controller 42 has its own custom software that verifies the integrity of the values reported by sensors 40, 44 and 46. An example would be that micro-controller 42 has the ability to detect a failed sensor. The sensors values acquired by micro-controller 42 through A/D converter 48 are reported back to computer 34. This cycle of sensor data is acquired continuously throughout the test session. The reported sensed data is then used to calculate a variety of system operating parameters. For example, superheat, supercooling, condensing temperature, evaporating temperature, and other operating parameters can be determined. The software within computer 34 then compares these values individually or in combination with the diagnostics rules programed and then based upon these comparisons, the software derives a set of possible causes to the differences between the measured values and the standard operating values. The diagnostic rules can range from simple limits to fuzzy logic to trend analysis. The diagnostic rules can also range from individual values to a combination of values.

For example, the current drawn by compressor 12 is related to the suction and discharge pressures and is unique to each compressor model. Also, the superheat settings are unique to each air-conditioning system. Further, the diagnostic rules are different for different system configurations like refrigerant type, expansion device type, compressor type, unloading scheme, condenser cooling scheme and the like. In some situations, the application of the diagnostic rules may lead to the requirement of one or more additional parameters. For example, the diagnostic system may require the indoor temperature which may not be currently sensed. In this case, the technician will be prompted to acquire this valve by other means and to input its value into the program. When the criteria for a diagnostic rule have been satisfied, then a cause or causes of the problem is displayed to the technician together with solutions to eliminate the problem. For example, a high superheat condition in combination with several other conditions suggests a low refrigerant charge and the solution would be to add refrigerant to the system. The technician can then carry out the suggested repairs and then rerun the test. When the system is again functioning normally, the test results and the sensed values can be saved for future reference.

While sensors 40 are disclosed as being hard wired to A/D converter 48, it is within the scope of the present invention to utilize wireless devices to reduce the number of wiring hookups that need to be made.

Also, while apparatus 30 is being disclosed as a diagnostic tool, it is within the scope of the present invention to include an automatic refrigerant charging capability through hoses 36 and 38 if desired. This would involve the addition of a control loop to meter refrigerant into the system from a charging cylinder. Accurate charging would be accomplished by continuously monitoring the system parameters during the charging process.

While the above detailed description describes the preferred embodiment of the present invention, it should be understood that the present invention is susceptible to modification, variation and alteration without deviating from the scope and fair meaning of the subjoined claims.

What is claimed is:

1. An apparatus for servicing a malfunctioning air-conditioning system including an electric motor, said apparatus comprising:

a first sensor for sensing a first operating parameter of said malfunctioning air-conditioning system;

a second sensor for sensing a second operating parameter of said malfunctioning air-conditioning system;

a third sensor for sensing a motor operating parameter of said malfunctioning air-conditioning system;

a micro-controller in communication with said sensors for receiving a signal from each of said sensors;

a hand held computer in communication with said micro-controller, said computer having a memory containing normal operating parameters for a plurality of air-conditioning systems, said computer being operable to compare said first, second and motor operating parameters with said normal parameters of one of said plurality of air-conditioning systems to diagnose said malfunctioning air-conditioning system.

2. The apparatus for servicing a malfunctioning air-conditioning system in accordance with claim 1, wherein said first operating parameter is a low side pressure of said malfunctioning air-conditioning system, said second operating parameter is a high side pressure of said malfunctioning air-conditioning system and said third operating parameter is a supply voltage to a compressor of said malfunctioning air-conditioning system.

3. The apparatus for servicing a malfunctioning air-conditioning system in accordance with claim 1, wherein said first operating parameter is a low side pressure of said malfunctioning air-conditioning system, said second operating parameter is a high side pressure of said malfunctioning air-conditioning system and said third operating parameter is a supply amperage to a compressor of said malfunctioning air-conditioning system.

4. The apparatus for servicing a malfunctioning air-conditioning system in accordance with claim 1, wherein said first operating parameter is a low side pressure of said malfunctioning air-conditioning system, said second operating parameter is a high side pressure of said malfunctioning air-conditioning system and said third operating parameter is a rotational speed of a compressor of said malfunctioning air-conditioning system.

5. The apparatus for servicing a malfunctioning air-conditioning system in accordance with claim 1, wherein said first operating parameter is a low side pressure of said malfunctioning air-conditioning system, said second operating parameter is a high side pressure of said malfunctioning air-conditioning system and said third operating parameter is a temperature of refrigerant in an evaporator of said malfunctioning air-conditioning system.

6. The apparatus for servicing a malfunctioning air-conditioning system in accordance with claim 1, wherein said first operating parameter is a low side pressure of said malfunctioning air-conditioning system, said second operating parameter is a high side pressure of said malfunctioning air-conditioning system and said third operating parameter is a temperature of refrigerant in a condenser of said malfunctioning air-conditioning system.

7. The apparatus for servicing a malfunctioning air-conditioning system in accordance with claim 1, wherein said first operating parameter is a supply amperage to a compressor of said malfunctioning air-conditioning system, said second operating parameter is a supply voltage to said compressor and said third operating parameter is a rotational speed of said compressor.

8. The apparatus for servicing a malfunctioning air-conditioning system in accordance with claim 1, further comprising:

a master computer disposed remote from said hand held computer; and a wireless connection between said hand held computer and said master computer.

9. The apparatus for servicing a malfunctioning air-conditioning system in accordance with claim 8, wherein said wireless connection includes a connection to the Internet.

10. The apparatus for servicing a malfunctioning air-conditioning system in accordance with claim 1, wherein said computer provides instructions for repairing said malfunctioning air-conditioning system.

11. The apparatus for servicing a malfunctioning air-conditioning system in accordance with claim 1, further comprising a barcode reader in communication with said hand held computer.

12. A method for servicing a malfunctioning air-conditioning system including an electric motor, said method comprising:

measuring a first operating parameter of said malfunctioning air-conditioning system;

measuring a second operating parameter of said malfunctioning air-conditioning system;

measuring a motor operating parameter of said malfunctioning air-conditioning system;

providing said operating parameters to a hand held computer;

selecting one air conditioning system from a plurality of air-conditioning systems which is equivalent to said malfunctioning air-conditioning system;

comparing normal operating parameters of said one air-conditioning system with said operating parameters of said malfunctioning air-conditioning system; and providing diagnostic results for said comparing step.

13. The method for servicing a malfunctioning air-conditioning system in accordance with claim 12, wherein said selecting step includes manual inputting an identifier of said malfunctioning air-conditioning system.

14. The method for servicing a malfunctioning air-conditioning system in accordance with claim 12, wherein said selecting step includes inputting an identifier of said malfunctioning air-conditioning system with a barcode reader.

15. The method for servicing a malfunctioning air-conditioning system in accordance with claim 12, wherein said selecting step includes communicating between said hand held computer and a master computer using a wireless connection.

16. The method for servicing a malfunctioning air-conditioning system in accordance with claim 15, wherein said communicating between said hand held computer and said master computer using a wireless connection includes communicating through the Internet.

17. The method for servicing a malfunctioning air-conditioning system in accordance with claim 12, wherein said providing diagnostic results includes providing instructions for repairing said malfunctioning air-conditioning system.

18. The method for servicing a malfunctioning air-conditioning system in accordance with claim 12, further comprising performing a test session prior to comparing said normal operating parameters with said operating parameters of said malfunctioning air-conditioning system.

19. The method for servicing a malfunctioning air-conditioning system in accordance with claim 12, further comprising updating said hand held computer from a master computer through a wireless connection.

20. The method The method for servicing a malfunctioning air-conditioning system in accordance with claim 12, further comprising measuring a fourth operating parameter of said malfunctioning air-conditioning system.

* * * * *

UNITED STATES PATENT AND TRADEMARK OFFICE

CERTIFICATE OF CORRECTION

PATENT NO. : 6,324,854 B1
DATED : December 4, 2001
INVENTOR(S) : Nagaraj Jayanth It is certified that error appears in the above-identified patent and that said Letters Patent is hereby corrected as shown below:

Column 1,
Line 10, "compute" should be -- computer --.

Column 2,
Line 17, "programed" should be -- programmed --.

Column 5,
Line 23, "diagnostics" should be -- diagnostic --.
Line 23, "programed" should be -- programmed --.
Line 43, "valve" should be -- value --.

Column 8,
Line 38, delete "The method" (second occurrence).

Signed and Sealed this

Seventeenth Day of September, 2002

*Attest:*

*Attesting Officer*

JAMES E. ROGAN
*Director of the United States Patent and Trademark Office*